United States Patent [19]

Oide

[11] 4,057,947

[45] Nov. 15, 1977

[54] JOINING AND FIXING STRUCTURE FOR CEILING BOARDS AND PANELLING

[76] Inventor: Kunimasa Oide, 3-33, Seiwadai-nishi-1, Kawanishi, Hyogo, Japan

[21] Appl. No.: 665,199

[22] Filed: Mar. 9, 1976

[30] Foreign Application Priority Data

Mar. 17, 1975 Japan ..... 50-32586

[51] Int. Cl.[2] ..... E04B 5/52

[52] U.S. Cl. ..... 52/496; 52/486

[58] Field of Search ..... 52/496, 494, 495, 592, 52/476, 464, 546, 573, 484, DIG. 5, 486, 359, 288

[56] References Cited

U.S. PATENT DOCUMENTS

| | | | |
|---|---|---|---|
| 2,854,706 | 10/1958 | Merlino | 52/496 |
| 3,339,331 | 9/1967 | Dail | 52/496 |
| 3,417,530 | 12/1968 | Long | 52/496 |
| 3,513,613 | 5/1970 | Jones et al. | 52/496 |
| 3,672,107 | 6/1972 | Santry et al. | 52/496 |
| 3,729,883 | 5/1973 | Thompson | 52/496 |
| 3,832,816 | 9/1974 | Jahn | 52/496 |
| 3,863,413 | 2/1975 | Moomey | 52/496 |
| 3,875,717 | 4/1975 | Moeller | 52/496 |
| 3,900,997 | 8/1975 | Ollinger et al. | 52/496 |
| 3,943,680 | 3/1976 | Balinski | 52/496 |

*Primary Examiner*—Price C. Faw, Jr.
*Assistant Examiner*—Robert C. Farber
*Attorney, Agent, or Firm*—Bierman & Bierman

[57] ABSTRACT

This invention relates to a novel structure for securely joining ceiling boards, wainscots and other similar types of paneling and boarding to supports or base members such as joists or furring strips. This joining structure finds application in securing ceiling boards (such as gypsum boards or slag wool boards) having relatively low mechanical strength to joists. Employment of the novel and unique joining devices permits easy construction and assembly at high working efficiency. Since the boards are joined together securely by the devices fitted into slots formed at the edges of the boards and are not suspended from the ceiling but are tightly attached to the joists, an elegant and monolithic finish as well as increased structural strength is provided.

6 Claims, 15 Drawing Figures

FIG. 12
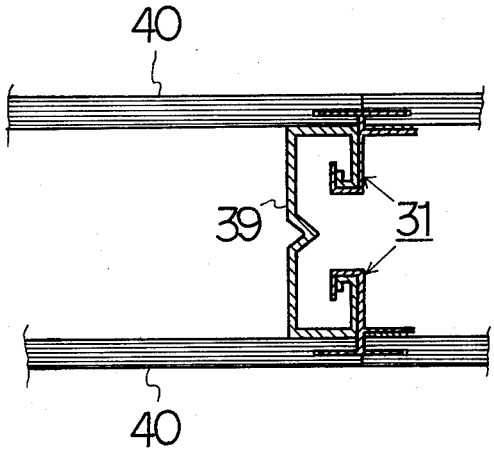
FIG. 14
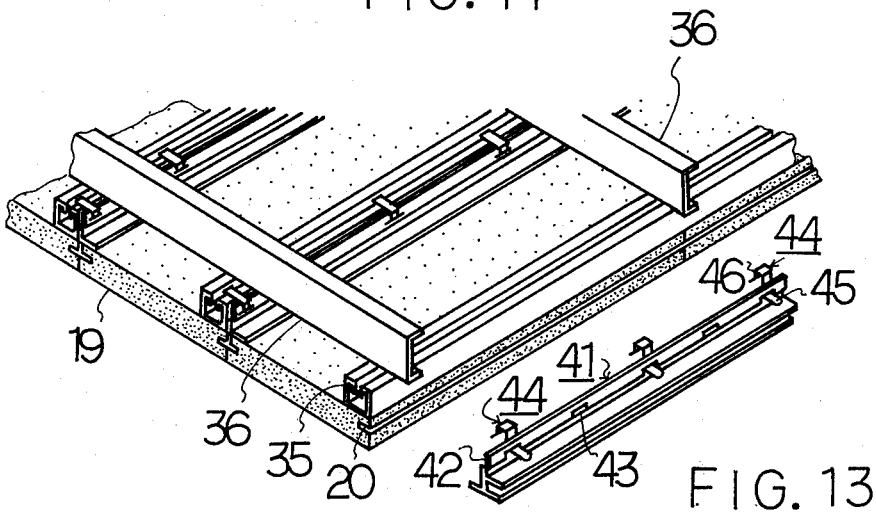
FIG. 13
FIG. 15
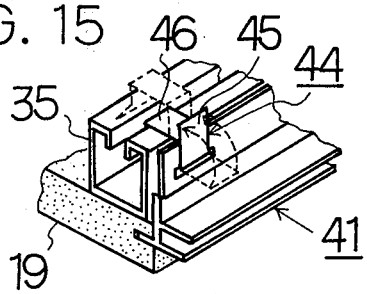

JOINING AND FIXING STRUCTURE FOR CEILING BOARDS AND PANELLING

This invention relates to a joining structure adaptable for securing ceiling boards, wainscots or other like boarding or paneling to support or base members such as joists or furring strips.

For securing ceiling boards to wooden supports, it has been commonly practiced heretofore to directly nail the boards to the supports by driving nails into the boards from their underside or, in some cases, to employ both nailing and bonding by an adhesive. Such methods, however, have several drawbacks. Firstly, it is necessary to use broad or large-sized support members at the joints of the ceiling boards, resulting in increased amount and cost of material used. This is also true if the support members are not wooden ones but lightweight steel bars or frames. Weight saving in interior paneling is desirable, particularly for high-rise or multistoried buildings. However, the use of support members with a greater breadth than necessary for providing the desired supporting strength militates against achieving this end.

Also, when driving nails or applying adhesive for fixing the ceiling boards, the worker must perform such work in an unnatural, awkward position (directly up) so that he is easily fatigued and his working efficiency is lowered. In addition, since the entire weight of the ceiling boards is carried by the nails and/or adhesive layer, it is necessary to use a great number of nails and/or a large amount of adhesive, which also contributes to the low working efficiency. Moreover, the nail heads remain exposed on the surface of the ceiling boards, giving an esthetically unsatisfactory appearance in the finished surface.

Recently, improvements have been made in means for fixing said ceiling boards, wainscots or the like, and various methods have been proposed for indirectly securing the boards to the supports by use of certain joining or clamping devices. Typical examples of such methods are disclosed, for instances, in U.S. Pat. Nos. 3,251,164; 3,313,076; and 3,513,613.

In the first-mentioned U.S. Pat. No. 3,251,164 is disclosed a method in which the ceiling planks formed with slits at the edges are fitted edgewise with the horizontal fixing blocks by making use of said slits to thereby successively join the planks. This method overlaps partly with the concept of the present invention, but in the former, securing of the ceiling boards to the joists is accomplished by driving nails thereinto from the lower side, so that the joining work is not easy to carry out. Since the ceiling boards are not attached closely to the joists but spaces are formed therebetween, this method cannot be applied where boards with relatively low mechanical strength, such as gypsum boards used for the ceiling.

According to the techniques shown in the second-mentioned U.S. Pat. No. 3,313,076, although the ceiling boards are attached closely to the supports, they are not engaged through the edge slits. The ceiling boards, which are elastic in the direction of their thickness, are forced into the fixed in the spaces between the horizontal fixing strips of the joining means and the supports. Therefore, this method is inapplicable where inelastic boards (such as those of gypsum) are used for the ceiling. Also, the joining means are designed for nailing from the lower side.

The last-mentioned U.S. Pat. No. 3,513,613 shows techniques for suspending the clamping means by utilizing the side edges of the joists to constitute the supports. This device is very useful in certain applications. However, the clamping means for the ceiling boards depends therefrom and is not perfectly secured to the joists. Also, the ceiling boards are suspended with the aid of the slits provided at the edges, so that this structure cannot be applied unless the ceiling boards have high strength. In this cited patent, film faced fibrous bodies fabricated of fibers of minerals such as glass are used as ceiling boards, and also the fibrous body portion and film extending beyond both side edges of the body are adapted to serve as a part of the support for the ceiling boards.

The primary object of the present invention is to provide a structure for securing ceiling boards supported by joining devices to base members, said structure comprising joining devices constructed so that each such device can be secured sidewise to each base member. The joining device itself is also specifically designed to provide sufficient supporting strength so that relatively low strength materials, such as gypsum boards, can be used. The design also permits a ceiling construction where the ceiling boards are joined together successively by the slits formed at the side edges.

The joining device and structure according to the present invention is for securing ceiling boards, wainscots or similar planks to base members such as joists or furring strips. In the devices of the present invention, each joining device is set so that its vertical plate portion is firmly attached to one side of a corresponding base member (such as joists or furring strips) and secured thereto by nailing. The engaging plate portion extending horizontally in both direction from one end of the vertical plate portion is force-fitted into sized formed in the corresponding edges of the adjoining boards, so that the boards are fixed in position in tight attachment with the faces of the joists or furring strips; thereby joining together the boards successively in edge-to-edge relation.

The construction as well as action and effect of the present invention are described in detail with reference to the accompanying drawings, in which:

FIG. 1 is a perspective view of a joining device fabricated in accordance with the present invention for application to wooden joists, furring strips or the like;

Figure 7:
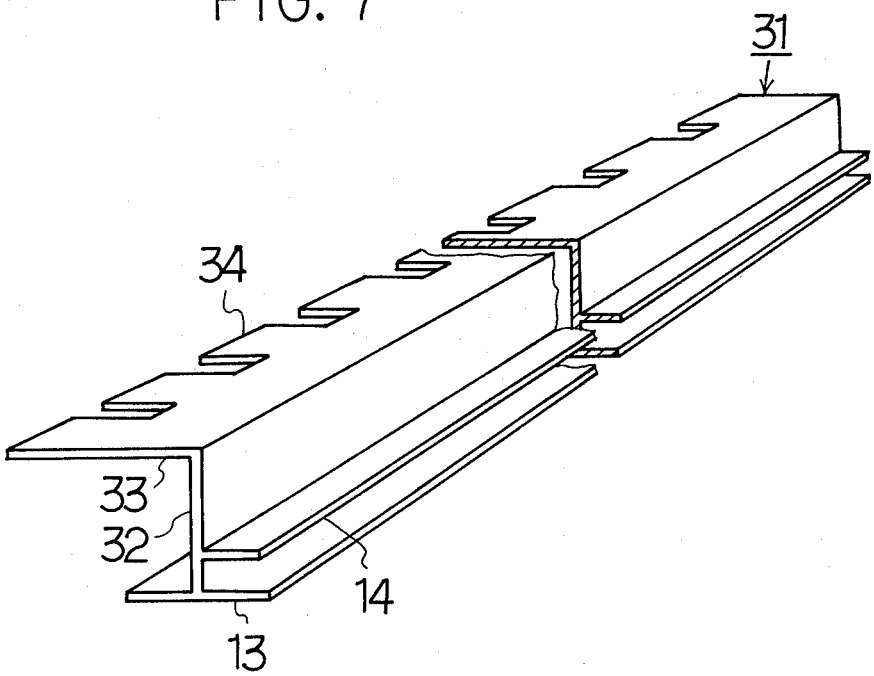
FIG. 7 is a perspective view of joining device designed for use with lightweight steel joists, furring strips or the like in accordance with the present invention.

FIG. 12 is a fragmentary sectional view of a wall structure employing the joining devices of FIG. 7 for securing wall panels and furring strips for double-butt panels; and FIGS. 13 to 15 are fragmentary sectional views showing a split type joining device, which is a modification of the joining device of FIG. 7, and a ceiling structure where such modified joining devices are employed for supporting the ceiling boards.

Figure 1:
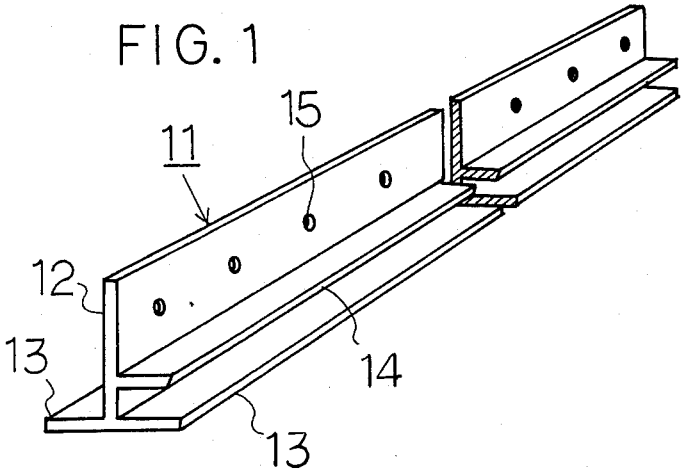

Referring to FIG. 1, there is shown a joining device, generally designated by reference numeral 11, according to the present invention. This joining device is an elongated body having the same cross sectional shape along its length and fabricated from metal or synthetic resin by extrusion molding or flexure molding. This joining device 11 has a flat vertical supporting plate portion 12, and a horizontal engaging plate portion 13 perpendicular to portion 12 and extending horizontally in both directions from one edge of plate portion 12. There is also provided a rim flange 14 extending horizontally from one side of vertical plate portion 12, parallel to portion 13 and spaced vertically apart therefrom, so that there is formed between said flange 14 and said horizontal plate portion 13, a space equal to the distance from the surface of the ceiling board or the like to the engaging slit formed therein. Also formed in said vertical plate portion 12 are a plurality of nailing holes 15 arranged at suitable intervals.

Figure 2:
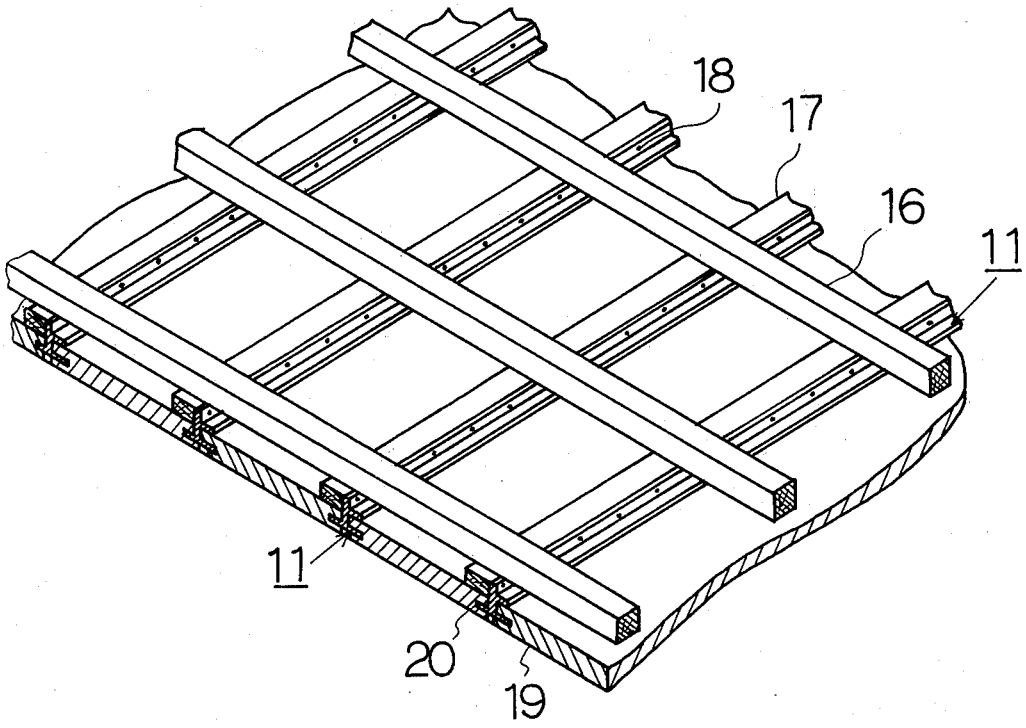
FIG. 2 is a fragmentary perspective view of a ceiling structure employing said joining devices for supporting the ceiling boards.
Figure 3:
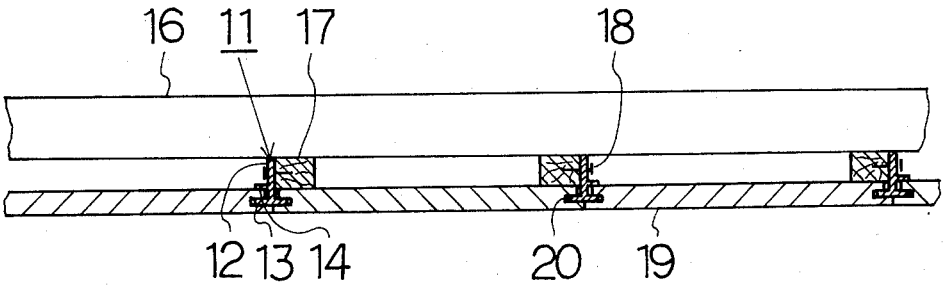
FIG. 3 is a sectional view showing the joined structure.

Joining devices 11, when used for construction of a ceiling assembly, are applied to a base structure comprising a plurality of wooden joists 17 secured to joist supports 16 at right angles thereto, as shown in FIGS. 2 and 3. It will be seen that each joining device 11 is secured at its vertical plate portion 12 to one side of a corresponding wooden joist 17 by means of nails 18 driven through said nailing holes 15 into said joist 17, while the horizontal plate portion 13 is fitted into the respective slits 20 formed in and along the opposed edges of the adjoining ceiling boards 19 to thereby secure the ceiling boards in position. This joining operation is repeated to securely join the ceiling boards 19 successively in supporting engagement with the joists thus providing a ceiling structure. If need be, an adhesive may be applied at the parts where the joists 17 and ceiling boards 19 are attached closely to each other.

FIG. 3 shows a form of ceiling structure assembled by using the joining devices of the present invention, but if this structure is turned vertically, it becomes a wall structure, with the joists 17 serving as furring strips and the ceiling boards 19 as wainscots.

Figure 4:
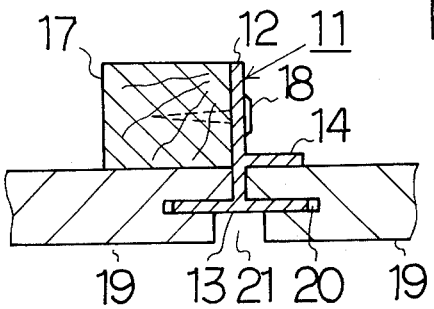
FIG. 4 is a fragmentary sectional view showing the joint between the joining device of FIG. 1 and a joist and two ceiling boards.

FIG. 4 is a fragmentary sectional view showing joist 17 and two ceiling boards 19 held together by means of the joining device 11 of FIG. 1. In this arrangement, a joint clearance 21 is provided between the adjoining ceiling boards to form an openwork structure.

Figure 5:
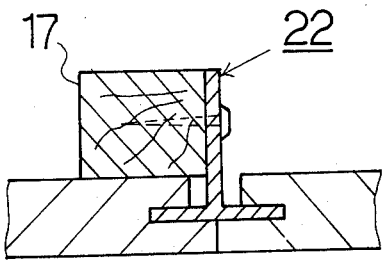
FIG. 5 and 6 are fragmentary sectional views showing similar joints using other forms of joining devices in accordance with the present invention.
Figure 6:
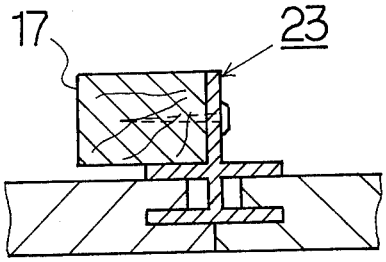

FIG. 5 shows an inverted T-shaped joining device 22 which is devoid of the flange 14 and is here shown adapted for joining ceiling boards 19. FIG. 6 shows a modified joining device 23 provided with rib flanges 16 extending outwardly from both sides of the vertical plate portion 12. Either of these joining devices provides a simple and strong joined structure like the joining device 11. In the structure shown in FIG. 5, no supporting flange is present along the upper edge of one of the adjoining ceiling boards 19 and also no joist is positioned at this part, so that the ceiling boards are supported only by the horizontal plate portion 13 fitted in the corresponding slits 20 formed in said ceiling boards, but since the underside of joist 17 is attached tightly along the upper edge of the other ceiling board, sufficient supporting strength is provided.

According to the above-described joint structures, the ceiling boards are joined to each other successively by engagement of the horizontal plate protions of the joining devices of this invention in the corresponding slits in the boards. The upper side of each ceiling board is attached securely to a joist or a flange of the joining device, and the vertical plate portion of each joining device can be nailed to a side of a wood joist with ease. Thus, employment of the joining devices of this invention eliminates the necessity for broad or voluminous joists as required by the prior art, and permits the use of joists no larger than those required for supporting strength, thus resulting in appreciable weight saving in the ceiling support structure.

Also, since the direction in which the nails are driven is perpendicular to the direction in which the load is applied, it is possible to decrease the number of nails required. Further, since the nails are hammered horizontally, the nailing operation is easy to perform and the efficiency of the workman is markedly enhanced as compared with the conventional mode of ceiling construction. Moreover, since the ceiling supporting structure is provided by engagement of the horizontal plate portions of the joining devices in the corresponding slits formed in the ceiling boards, the nail heads are completely concealed from the external or exposed surface of the ceiling boards and no temporary fastening work is required during drying of the adhesive, thus allowing the formation of a beautiful finish. Also, if desired, an openwork finish such as shown in FIG. 4 can be effected with ease.

Figure 8:
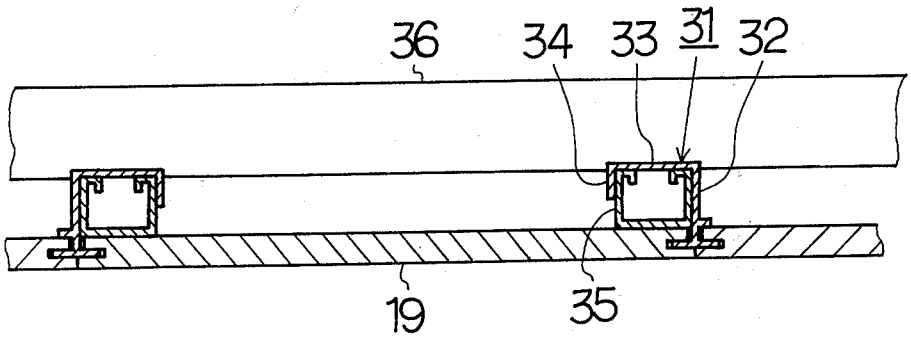
FIG. 8 is a fragmentary sectional view of a ceiling structure employing the joining devices of FIG. 7 for supporting the ceiling boards.

The concept of the present invention can also be adapted for a ceiling structure in which the joists or furring strips are made of metal such as iron, aluminum alloy, etc. Frequently lightweight iron or steel bars having the sectional shape as shown in FIG. 8 are used as base members. In this case, it is only necessary to change the manner of securing the joining devices to the lightweight steel bars.

The joining devices of the foregoing embodiments can be used by merely changing the upper edge configuration of the vertical plate portion of the unit joining device. Thus, each unit joining device 31 shown in FIG. 7 has a catch plate 33 extending horizontally from the top edge of the vertical plate portion 32 and having a pectinate end formed with flexible flaps 34. The lower portion of this joining device is of the same construction as joining device 11 shown in FIG. 1 for application to wooden joists; that is, it has a horizontal engaging plate portion 13 and a rib flange 14.

FIG. 8 is a fragmentary sectional view showing a ceiling structure employing the joining devices 31 of FIG. 7 for joining together ceiling boards 19. In using this joining device 31, first catch plate 33 is placed in abutment with the upper edge of a corresponding lightweight steel joist 35, and then flaps 34 at the end of said plate 33 are bent down by hand so that the joining device is suspended from joist 35. The joists 35 are secured to their supports 36 by welding, bolting or other suitable known means. Engagement of the joining devices 31 with the ceiling boards 19 is the same as that already described in connection with joining devices 11 used with wooden joists, so no further explanation in this respect will be necessary.

Figure 9:
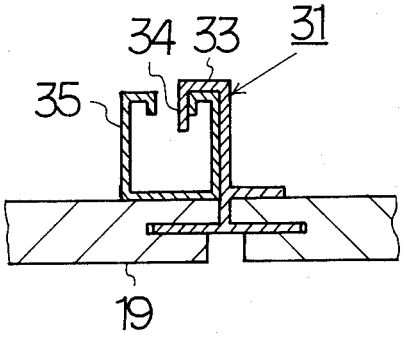
FIG. 9 is a fragmentary sectional view showing the use of the joining device of FIG. 7 with a joist and two ceiling boards.
Figure 10:
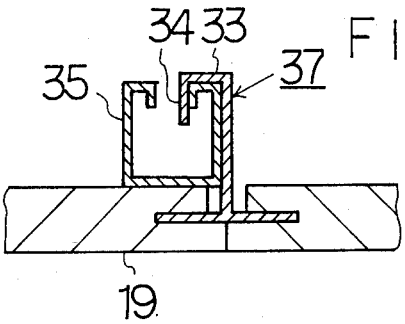
FIGS. 10 and 11 are fragmentary sectional views showing the similar joints employing other forms of joining devices in accordance with the present invention.
Figure 11:
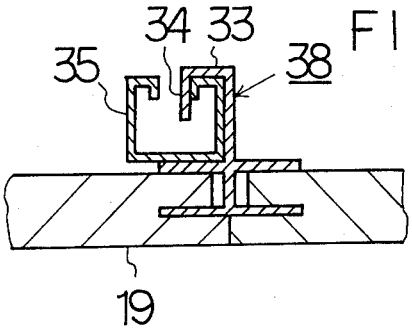

The structures shown in FIGS. 9 to 11 correspond to those shown in FIGS. 4 to 6. However, in the latter case, securing of the joining devices to the wooden joists is accomplished by nailing while, in the application to lightweight steel joists, it suffices to merely attach the vertical plate portion of each joining device to a side of a corresponding joist and then secure them to each other by means of catch plate 33 and flaps 34. The structures of FIGS. 9 to 11 differ from that of FIG. 8 in that the catch plate is smaller in width and that the flaps 34 are bent inside of the joist. This arrangement permits a simpler and more secure fixation than is attainable with the structure of FIG. 8. As for the construction of the lower portion, joining device 37 is identical with joining device 22, and joining device 38 is the same as joining device 23.

FIG. 12 shows in section, a joined wall structure where wall panels 40 are secured to double butt panel furring strips 39 by using joining device 31 shown in FIG. 7.

Referring now to FIGS. 13 to 15, there is shown still another embodiment of the joining device of the present invention applicable to lightweight steel joists. FIG. 13 show a joining device of this embodiment which is a modification of the device shown in FIG. 7 and where th catch plate and flaps are separate elements from the vertical plate portion. This unit can, in certain applications, improve the working efficiency and also allow saving of material. This joining device 41 has its vertical supporting plate 42 provided with a stepped portion as shown in the drawings, with a row of slits 43 being provided at suitable intervals in the part above the stepped portion.

This joining device 41 is used in the following way for securing ceiling boards 19 to joists 35. As shown in FIGS. 14 and 15, an upper edge of a ceiling board 19 is first attached closely to the underside of a joist 35. Then one side of the horizontal engaging plate 13 of the joining device is fitted into a corresponding slit 20 in said ceiling board. Vertical plate 42 is attached to a corresponding side of the joist, and tongue 45 of separate plug-in hook 44, is inserted into slit 43 and the upper edge of the joist is caught by catch element 46. Then tongue 45 is bent upwardly to thereby fix the assembly in a tightly joined relationship.

This form of joining device of the invention, as adapted for securing ceiling boards to lightweight steel joists, eliminates the need for broad or large-sized joists; that is, all the joists used may be of small size, so that substantial savings of labor and material cost are ensured. The joining operation is also easy and simple, and in actual use, was up to two to four times as fast as conventional methods.

What is claimed is:

1. Means for forming a planar surface comprising a plurality of substantially parallel base members spaced apart and parallel to said surface, each of said members being provided with a joining device, each said joining device comprising a substantially flat upstanding plate portion adjacent one side of each of said base members and affixed thereto, an engaging plate substantially perpendicular to said upstanding plate and extending on either side of the edge of said upstanding plate remote from said base members, a plurality of substantially flat members adapted to form said surface and having slits corresponding to said engaging plate, said engaging plate in said slits, whereby said flat members are securely joined in an end-to-end relationship, each said joining device being provided with a rib flange perpendicular to said upstanding plate and extending outwardly from one side of said upstanding plate, said flange being parallel to said engaging plate and spaced therefrom by a distance substantially equal to the thickness of said flat members from said surface to said slits.

2. Means according to claim 1 wherein said joining device has a T-shaped cross section.

3. Means according to claim 1 wherein said rib flange extends on either side of said upstanding plate.

4. Means according to claim 1 wherein said upstanding plate is provided with a plurality of nail holes.

5. Means according to claim 1 wherein a catch plate extends perpendicularly to said upstanding plate from the edge thereof remote from said engaging plate, said catch plate comprising a plurality of bendable flaps, whereby said joining device is secured to said base member by bending said flaps thereover.

6. Means according to claim 1 wherein said upstanding plate has a plurality of longitudinally spaced apart slots therethrough, a plurality of hook elements each passing through one of said slots and having one end extending over at least a part of said base member, the other end of said hook element extending out of said slot on the side remote from said base member, said other end adapted to be bent whereby said device is secured to said base member.

* * * * *